US005634242A

United States Patent [19]

Ferrari et al.

[11] Patent Number: 5,634,242

[45] Date of Patent: Jun. 3, 1997

[54] COMPACT FURNIUTURE HINGE

[75] Inventors: Franco Ferrari, Frazione Deviscio, 2, 22053 Lecco; Carlo Migli, Lecco, both of Italy

[73] Assignee: Franco Ferrari, Lecco, Italy

[21] Appl. No.: 581,895

[22] Filed: Jan. 2, 1996

[30] Foreign Application Priority Data

Jan. 24, 1995 [IT] Italy ..... MI95U0038

[51] Int. Cl.[6] ..... E05D 15/32

[52] U.S. Cl. ..... 16/370; 16/335

[58] Field of Search ..... 16/370, 368, 369, 16/366, 335, 286, 287, 288

[56] References Cited

U.S. PATENT DOCUMENTS

| | | | |
|---|---|---|---|
| 4,050,116 | 9/1977 | Salice | 16/288 |
| 4,654,930 | 4/1987 | Lautenschlager, Jr. | 16/288 |
| 4,894,884 | 1/1990 | Lautenschlager, Jr. | 16/288 |
| 4,972,546 | 11/1990 | Lautenschlager, Jr. et al. | 16/370 |
| 5,008,977 | 4/1991 | Lautenschlager et al. | 16/288 |
| 5,373,609 | 12/1994 | Ferrari et al. | 16/370 |
| 5,497,534 | 3/1996 | Caruso | 16/370 |

FOREIGN PATENT DOCUMENTS

| | | | |
|---|---|---|---|
| 0395804 | 11/1990 | European Pat. Off. . | |
| 2851774 | 6/1980 | Germany . | |
| 8909532 | 11/1989 | Germany . | |
| 3840245 | 5/1990 | Germany | 16/370 |

*Primary Examiner*—Chuck Y. Mah

*Attorney, Agent, or Firm*—Shlesinger Fitzsimmons Shlesinger

[57] ABSTRACT

A furniture hinge (10, 110) has a wing (11, 111) and a cup (12, 112) interconnected with each other by a lower link rod (14, 114) and an upper link rod (15, 115). A torsion spring (25, 125) is wound round a pin (21, 121) inside the wing and parallel to the pivots of the link rods so as to have a thrust arm (22, 122) which acts upon a protrusion (20, 120) of the lower link rod facing towards the pin of the spring to push the hinge towards the closed position during a last section of the movement. The pivoting of the lower link rod (14, 114) to the wing is substantially between the pin (21, 121) of the spring and the pivoting of the upper link rod (15, 115) to the wing. The torsion spring advantageously has a reaction arm (123) which rests on the lower link rod (114).

8 Claims, 3 Drawing Sheets

COMPACT FURNIUTURE HINGE

BACKGROUND OF THE INVENTION

This invention refers to a furniture hinge having an innovative solution in the spring-operated closing mechanism. In particular, the innovative disposition of the mechanism makes it possible to obtain "gently" closing compact hinges.

For many years widespread use has been made of articulated furniture hinges provided with a spring-operated mechanism which enables the door to close automatically. Among these are some particularly interesting hinges from the commercial point of view which close "gently", that is to say which snap shut only at the last few degrees of closure, while remaining free for the remaining span of the movement. Various configurations of positioning and action of the spring-operated mechanism are known in the known technique. For example, use is very often made of a torsion spring wound round the pivot pin of the upper link rod of the hinge to act upon a cam protrusion on the lower link rod.

These configurations, however, call for relatively large space inside the wing. In particular, they call for a relatively large space between the pivot of the lower cam and the ceiling of the wing, such space having to accommodate the spring and the cam protrusion and permit their movement. This restricts the design of the hinge enormously, since the pivoting of the link rod has to be positioned well below the pivoting of the other arm, around which the spring is wound. This results in considerable limitation to the kinematic performance of the hinge. This inconvenience is all the more critical the smaller the hinge is. With the known solutions it is therefore virtually impossible to obtain "gently-closing" hinges of limited dimensions. For hinges of very limited dimensions it is consequently necessary to do without the "gentle" closure. The only expedient has been to place a leaf spring outside the wing, resulting in considerable problems in assembling the hinge as well as aesthetical problems.

The general scope of this invention is to obviate the aforementioned problems, by providing a hinge with a spring-operated closing mechanism which, while retaining its features of "gentle" closure, makes it possible to produce a hinge of very limited dimensions, advantageously also providing extensive freedom in the positioning of the spring-operated mechanism and outstanding kinematic efficiency.

SUMMARY OF THE INVENTION

This scope is achieved according to the invention by providing a furniture hinge having a wing and a cup interconnected with each other by a lower ink rod and an upper link rod pivoted at one end to the cup and at the other end to the wing, so that the wing and cup are reciprocally articulated so as to be movable between a closed hinge position and an open hinge position, a torsion spring having a thrust arm which acts on one of the link rods to push the hinge towards the closed position during the last section of its movement from the open to the closed position characterized by the fact that the spring is wound round a pin inside the wing and parallel to the pivoting of the link rod, the pivoting of the lower link rod to the wing being substantially between the pin of the spring and the pivoting of the upper link rod to the wing the end of the lower link rod which is pivoted to the wing having a portion facing towards the pin of the spring which has a cam protrusion on which the thrust arm of the spring rests in order to push it towards the closed position.

BRIEF DESCRIPTION OF THE DRAWINGS

The innovative principles of this invention and its advantages with respect to the known technique will be more clearly evident from the following description of a possible exemplificative and non restrictive embodiment applying such principles, with reference to the accompanying drawings, in which.

DETAILED DESCRIPTION OF THE INVENTION

Figure 1:
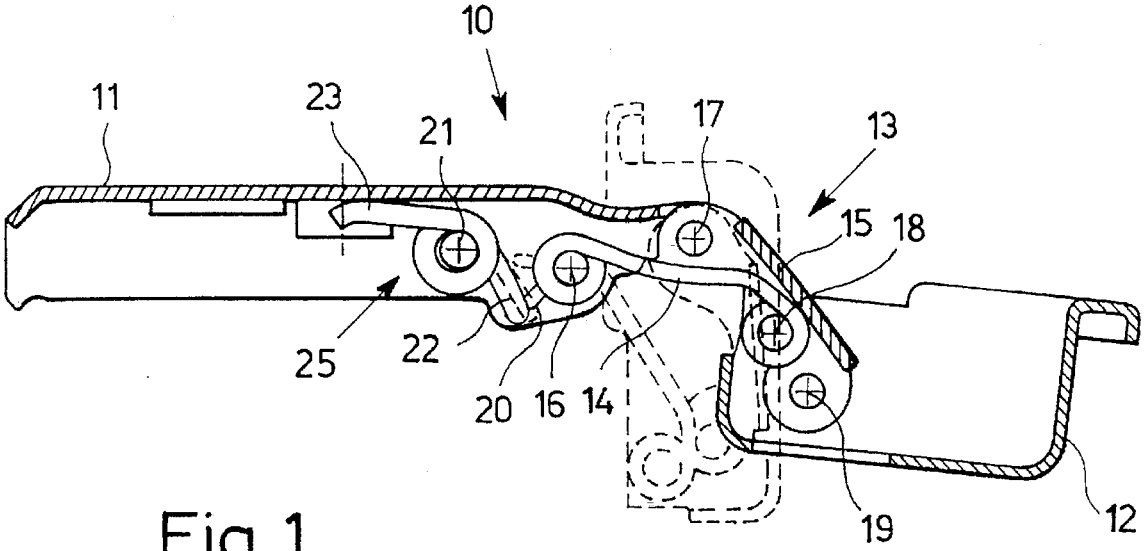
FIG. 1 shows a partially cutaway schematic side view alone the line I—I of FIG. 2 of a hinge in the open position.

With reference to the figures, FIG. 1 shows a hinge according to the invention; generically indicated by reference 10. The binge 10 comprises a wing 11 and a cup 12 connected to each other by means of an articulation 13 composed of an arm or lower liner rod 14 and an arm or upper link rod 15; pivoted. respectively to the wing at 16 add 17 and respectively to the cup at 18 and 19.

According to the known technique, the wing is designed to be secured to a furniture unit by means of known fastening means, for example adjustable, not shown, while the cup is designed to be secured in a complementary recess provided in a door.

According to the innovative principles of this invention, wound around a further pin 21 transversal to the wing is a double torsion spring 25, for example, made of wire. The pin of the spring 25 is disposed in the wing so that the pin 16 of the lower link rod is positioned between the pin of the spring and the pin 17 of the upper link rod, and almost on a line joining the centers of the pins 17 and 21. The lower link rod 14 has portions of one end thereof wound round the pivot 16 adjacent opposite ends thereof, and has an integral lateral cam protrusion 20 on its same end directed into the space between the pin 16 of the lower link rod and the pin 21 of the spring and therefore is directed substantially away from and in the opposite direction to the pin 17 of the upper link rod.

Figure 2:
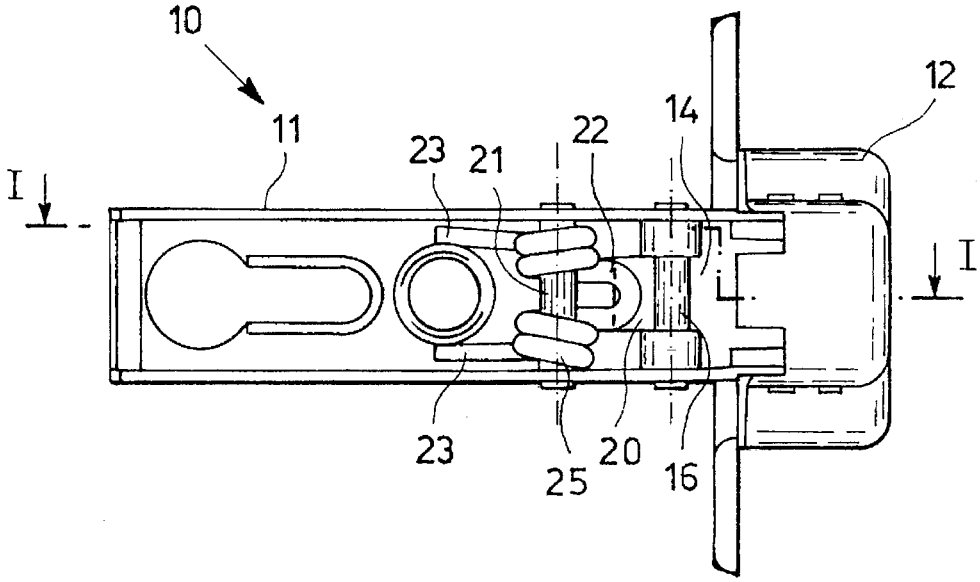
FIG. 2 shows a schematic bottom view of the hinge of FIG. 1 in the closed position.

As can be clearly seen in FIG. 2 the protrusion 20 can be obtained by cutting and unfolding a central area of the same end of the link rod 14 made of folded sheet metal. The spring 25 has one thrust end 22 which rests on the cam protrusion 20 and a second end engaging and reacting on the wing. In particular, the second end of the spring is made in the form of parallel arms 23, each resting inside the ceiling of the wing.

As can be seen in FIG. 1 from the comparison between the continuous line drawing (shown the open hinge) and the broken line drawing (showing the closed hinge) the closing movement of the hinge causes the spring to stretch. During the movement the cam protrusion remains beneath a line ideally traced between the centres of the pins 16 and 21. As will be obvious to the expert in the field, by suitably dimensioning and positioning the spring and cam protrusion to adjust the thrust arm on the protrusion according the angle of rotation of the link rod, the closing action can be made to take place mainly at a desired angle near to the complete closing, so as to provide a "gentle " closing action. The action of the spring, directed upwards, is highly effective also due to the fact that proceeding towards the closure increases the arm applying pressure on the lower link rod, while it decreases the free arm of the spring, that is to say, the cam rests on the spring in a position increasingly nearer to the axis (pin 21) of its turns. From FIG. 1 it is obvious how a hinge according to the invention can be kept of limited dimensions, the reduction in height of the wing being in substance practically limited only by the external diameter of the coils of the spring.

Due to the advantageous efficiency offered by the closing mechanism made according to the invention it is possible to use springs with a relatively limited thrust and, therefore, with a smaller wire thickness. Moreover, the pivoting point of the spring is outside the kinematic mechanism of the hinge and consequently the design of the hinge does not have to take the dimensions of the spring into account.

Figure 3:
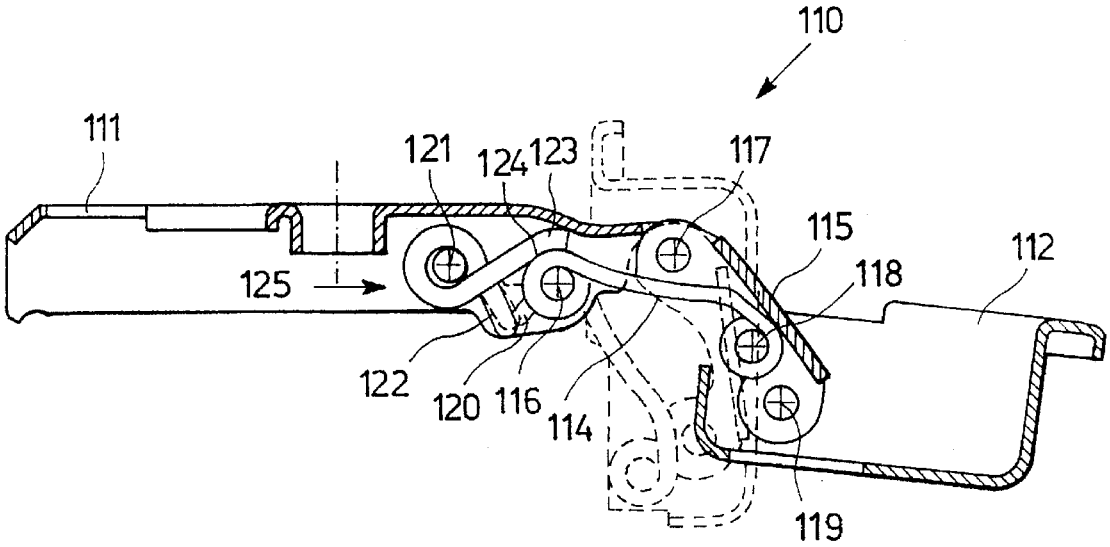
FIG. 3 shows a partially cutaway schematic side view along the line III—III of FIG. 4, of a second hinge in the open position.
Figure 4:
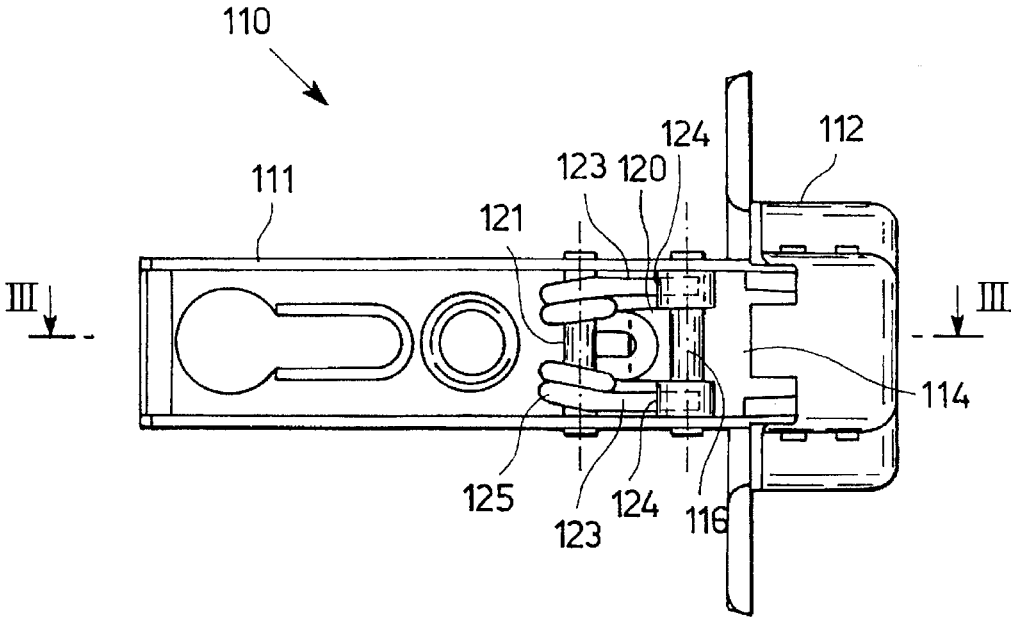
FIG. 4 shows a schematic bottom view of the hinge of FIG. 3 in the closed position.

FIGS. 3 and 4 show (indicating the elements similar to those of FIG. 1 by the same numbers preceded by one hundred) an advantageous variation to the hinge described up to this point. In this variation, the spring 125 is bent into an "alpha" shape so that the reaction end also rest on the end of the lower link rod 114. The reaction end rests in an area of the end of the link rod above the line of conjunction between the pin of the spring and the pivot of the link rod 114. In particular, as can be clearly seen in FIG. 4 the spring has reaction arms 123 which rest, in the vicinity of the lateral ends of the pivot 116, on a substantially cylindrical wound portion 124 of the end of the lower link rod 114.

In FIG. 3 it can be seen that when the hinge 110 moves open, the lower link rod compresses the spring by means of the protrusion or tab 120, pulling the opposing ends 122, 123 of the spring apart from each other. Upon reclosure of the hinge, an efficient thrust action is obtained, as previously described for the embodiment of FIG. 1.

In addition to the advantages described for the embodiment of FIG. 1 the fact that the spring 125 has resting points on the link rod and not on the wing permits considerable freedom in the positioning of the unit composed of spring 125 and link rod 114 inside the wing.

In particular, the assembly composed of the pin 121 of the spring and the protrusion 120 can be ideally rotated around the pivoting axis 116 of the link rod, maintaining the functioning of the closing mechanism unchanged. This enables the designer of the hinge to more effectively exploit the space inside the wing and avoid restrictions. In this way, it is extremely simple to design particular hinges; such as for example those of the type with curved or swan-necked wings, even of limited dimensions.

At this point it will be clear that the intended scopes have been achieved by providing a hinge with an efficient spring-operated closing mechanism which does not suffer from excessive dimensional restrictions.

Hinges according to the innovative principles of this invention have further advantages compared to the known technique also as regards their manufacture.

In fact, it is not necessary for example to preload the spring in order to be able to position it in the wing, as was necessary on the contrary in the known hinges.

Figure 5:
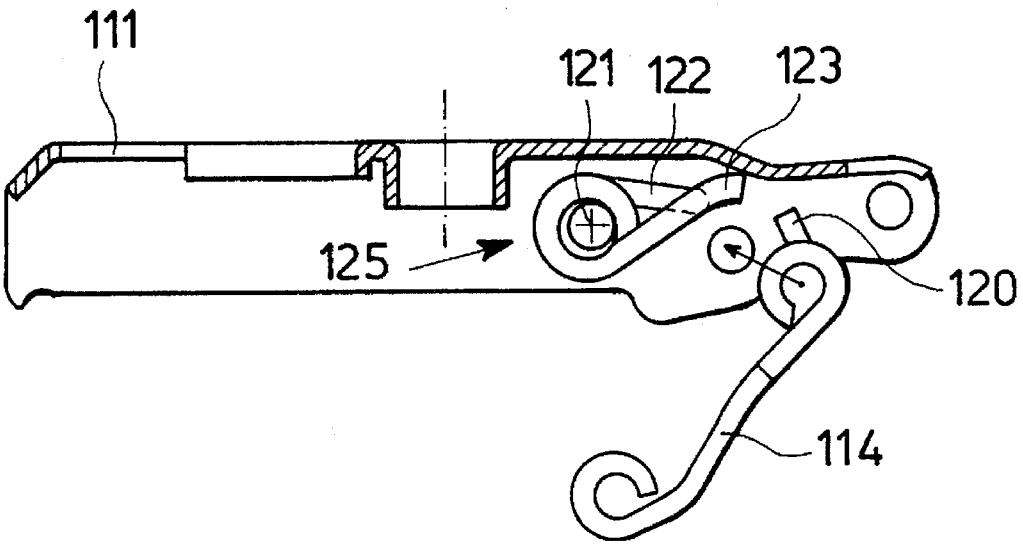
FIGS. 5 and 6 show partially cutaway schematic side views of a first and a second step of the assembly of the hinge of FIG. 3.
Figure 6:
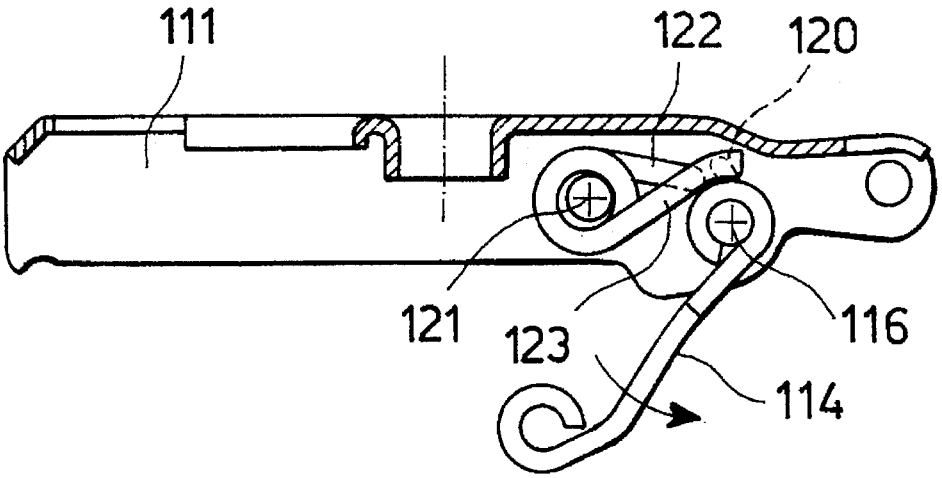

FIGS. 5 and 6 show an assembling sequence for assembling the spring and the lower link rod in the wing for the hinge of FIG. 3. As can be seen in FIG. 5, the spring is fitted and pivoted in the wing without any preloading whatsoever. After this the lower link rod is fitted in the wing with a simple rectilinear movement (in the direction indicated in FIG. 5), so as to be able to pivot it to the wing in a position with the protrusion 120 close to the end of the arm 122 of the spring, as shown in FIG. 6. Once the link rod and spring are pivoted, it is sufficient to rotate the link rod in the direction shown by the arrow in FIG. 6 to load the spring and shift the link rod into position to pivot it to the cup together with the upper link rod.

The various assembling phases are consequently extremely simple and do not call for special complicated tools, as are required for the known hinges.

If, when the spring is unload the arm 122 of the spring comes to rest with its free end over the line of conjunction between pins 16 and 21, it is sufficient for the arm to be of such length that the curve of the movement of the free end during the loading does not intersect the pin 116. In other words, the arm must be shorter in length than the free space between the pin of the spring and the pivot of the link rod.

The assembling procedure for the hinge of FIG. 1 is obviously similar.

At this point it will be clear that the intended scopes have been achieved by providing hinges with limited dimensions and a highly efficient closing mechanism. The foregoing description of embodiments applying the innovative principles of this invention is obviously given by way of example in order to illustrate such innovative principles and should not therefore be understood as a limitation to the sphere of the invention claimed herein. For example, thanks also to the innovative solution claimed herein, the exact shape of the hinge, the positioning of the parts and their relative size may differ from what has been shown in the figures. The spring and the link rod can also be made so that the cam protrusions are two in number, close to the two ends of the pin 16 and the spring rests on them by means of the two parallel arms 23 or 123, while the loop-shaped end 22, 122 constitutes the reaction end and rests either against the wing or on a cylindrical surface achieved rolling the link rod around the pin 16 in a central position to the two protrusions.

What is claimed is:

1. A compact furniture hinge having a wing and a cup interconnected with each other by a lower link rod and an upper link rod, each of said rods being pivoted at one end thereof to one of two parallel pivot pins secured to the cup and at the other end thereof to one of two further, parallel pivot pins secured to the wing, so that the wing and cup are reciprocally articulated so as to be movable between a closed hinge position and an open hinge position and a torsion spring having a thrust arm which acts on one of said link rods to push the hinge towards the closed position during the last section of its movement from the open to the closed position, and characterized by the fact that the spring is a double torsion spring wound intermediate its ends round a fifth pin mounted inside the wing and extending parallel to the pivotal axes of the upper and lower link rods, the pivot pin connecting the lower link rod to the wing being positioned substantially between the fifth pin supporting the spring and the pivot pin connecting the upper line rod to the wing, the end of the lower link rod which is pivoted to the wing having a portion thereof defining a cam protrusion facing towards said fifth pin, and the spring having formed intermediate its ends a central loop defining said thrust arm and being engaged with said cam protrusion to push said hinge towards the closed position.

2. Hinge as claimed in claim 1 characterized by the fact that the torsion spring has formed on one end thereof a pair of parallel reaction arms which rest on an internal portion of the wing.

3. Hinge as claimed in claim 1, characterized by the fact that the torsion spring has on one end thereof a pair of parallel reaction arms which rest on the lower link rod.

4. Hinge as claimed in claim 3, characterized by the fact that the reaction arms engage the end of the lower link rod which is pivoted to the wing.

5. Hinge as claimed in claim 3, characterized by the fact that the reaction arms of the spring rest on the end of the lower link rod pivoted to the wing, in a position above an imaginary line of conjunction between the fifth pin supporting the spring and the pivot of the lower link rod.

6. Hinge as claimed in claim 1, characterized by the fact that during movement of the hinge the cam protrusion moves along the thrust arm of the spring while remaining below an imaginary line of conjunction between said fifth pin and the pivot pin of the lower link rod to the wing.

7. Hinge as claimed in claim 1, characterized by the fact that the cam protrusion is made in the form of an extended central portion of the pivoted end of the lower link rod which is made from bent sheet metal.

8. Hinge as claimed in claim 1, characterized by the fact that the length of the thrust arm of the spring is shorter than the space between the fifth pin supporting the spring and the pivot pin connecting the lower link rod to the wing.

* * * * *